United States Patent [19]

Crum

[11] Patent Number: 4,964,396

[45] Date of Patent: Oct. 23, 1990

[54] FIREPLACE RESTORATION UNIT

[76] Inventor: Bruce P. Crum, 37 W. Glen Rd., Denville, N.J. 07834

[21] Appl. No.: 476,312

[22] Filed: Feb. 7, 1990

[51] Int. Cl.[5] ..... F24B 1/183

[52] U.S. Cl. ..... 126/508; 126/515; 126/517; 126/518; 126/522; 126/531; 126/532; 126/534

[58] Field of Search ..... 126/508, 515–518, 126/522, 523, 524, 526, 531, 533, 534, 307 R; 98/58, 60

[56] References Cited

U.S. PATENT DOCUMENTS 4,354,480 10/1982 Henderson et al. ..... 126/531

4,683,623 8/1987 Cannata ..... 126/523

4,846,147 7/1989 Townsend et al. ..... 126/307 R

*Primary Examiner*—Carroll B. Dority

*Attorney, Agent, or Firm*—Bernard J. Murphy

[57] ABSTRACT

The unit restores existing, masonry fireplaces without entailing dismantling of the latter. A heating jacket base, heating jacket, smoke chamber and flue lining are set into the existing firebox, smoke chamber and flue. Ducting is provided to move heating air through the heating jacket, and ducting is provided to pass combustion gases into the smoke chamber and flue. Internal air, or outside air, is accommodated in the unit for heating and combustion. Blowers are provided to move the heating air into the fireplace site (room) and/or to draw in outside air simply to exchange interior, stale air.

29 Claims, 5 Drawing Sheets

FIREPLACE RESTORATION UNIT

This invention pertains to masonry fireplace repair and improvement systems and devices, and in particular to a total fireplace restoration unit.

Masonry fireplaces, over the years, are known to settle, and this can cause dangerous, firehazard cracks to appear. Many fireplaces are so laden with creosote, in the firebox, smoke chamber, and flue, that they are unsafe to operate, and virtually impossible to clean. Older fireplaces, too, commonly do not meet present day codes for fire safety, to wit, those with unlined flues. Others vent poorly. Others have been destroyed by chimney fires.

Now, it is an object of this invention to set forth a novel fireplace restoration unit which, as the name implies, restores such aforesaid fireplaces, which requires no dismantling of the in-place, existing fireplace. The invention calls for no masonry skills for its emplacement, and does not require that any walls be removed.

It is particularly an object of this invention to disclose a novel fireplace restoration unit comprising a fireplace body, for emplacement within an existing masonry fireplace; and a flexible flue lining, (a) for coupling thereof to said body, and (b) for insertion thereof into the flue of such an existing masonry fireplace.

Further objects of this invention, as well as the novel features thereof, will become more apparent by reference to the following description, taken in conjunction with the accompanying figures, in which.

Figure 4:
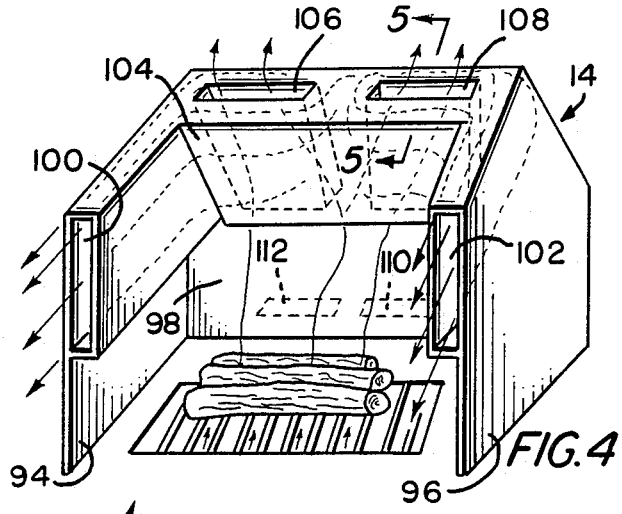
FIG. 4 is a frontal, perspective illustration of the heating jacket.
Figure 5:
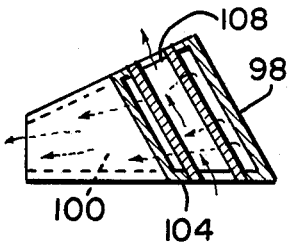
FIG. 5 is a cross-sectional view taken along section 5—5 of FIG. 4.
Figure 6:
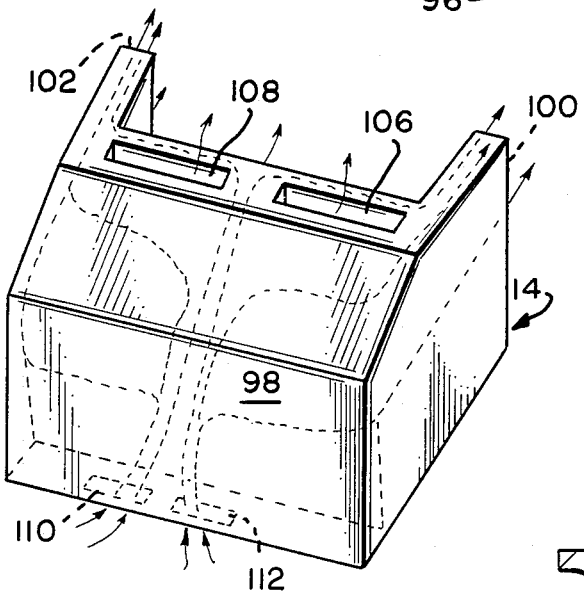
FIG. 6 is a rear, perspective illustration of the heating jacket.
Figure 1:
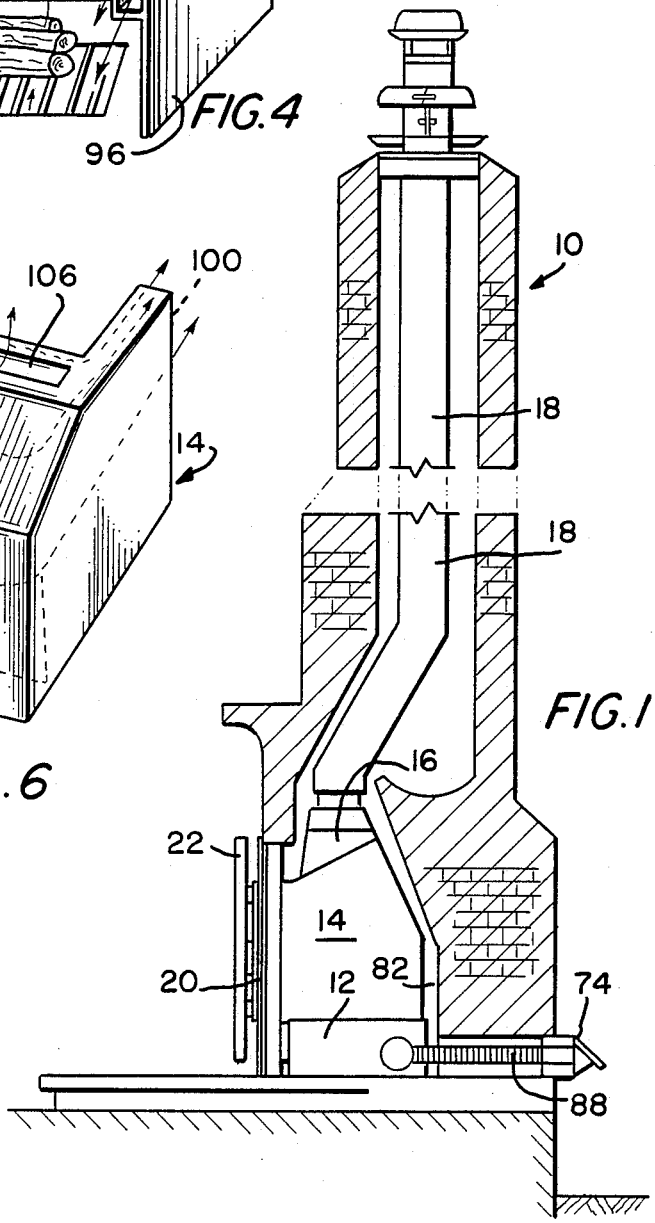
FIG. 1 shows an embodiment of the novel fireplace restoration unit, in simple line drawings, within a cutaway of an existing masonry fireplace.

As shown in the figures, the novel fireplace restoration unit 10 is open at the bottom thereof for setting directly upon, and for effecting an open communication thereof with, a fireplace hearth. The unit 10, according to an embodiment thereof, comprises a heating jacket base 12, upon which is mounted a heating jacket 14, a smoke chamber 16, and a flue lining 18. The heating jacket receives appropriate trim 20, and a front frame 22, all of which is depicted in FIG. 1. As shown, the heating jacket base 12, jacket 14, and smoke chamber 16 are fully recessed within an existing masonry fireplace.

Figures 2, 3:
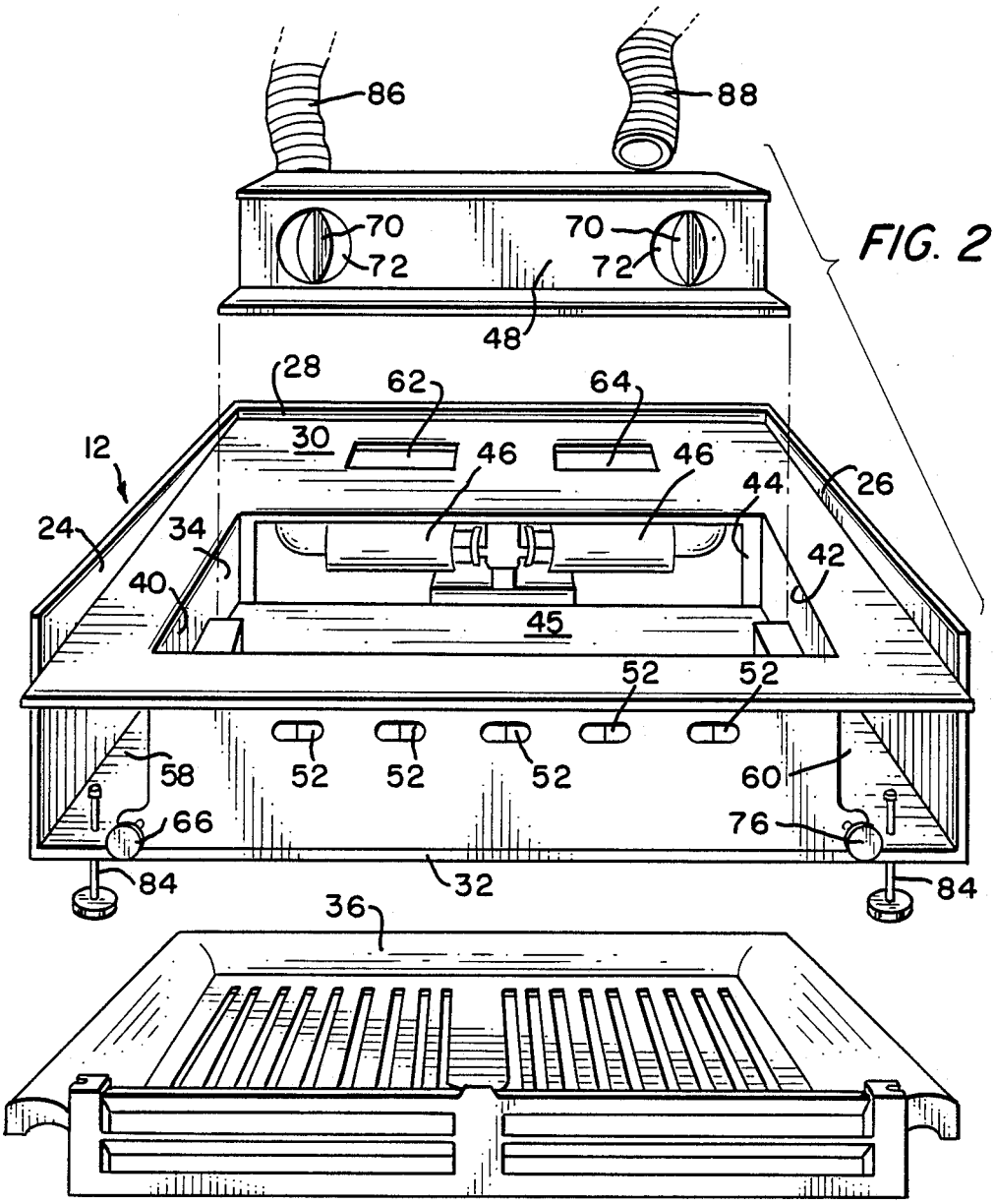
FIG. 2 is a front, perspective illustration of the heating jacket base of the embodiment of FIG. 1.
FIG. 3 is a front, perspective illustration of the grating for the unit.
Figure 7:
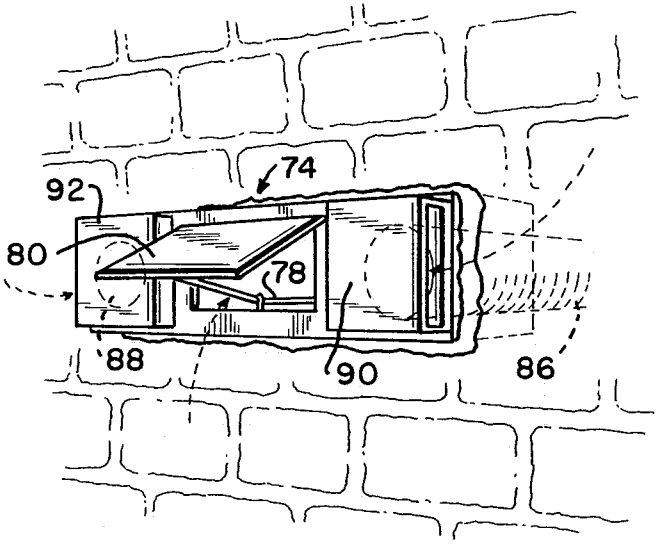
FIG. 7 is a perspective view of the outside air vent.
Figure 8:
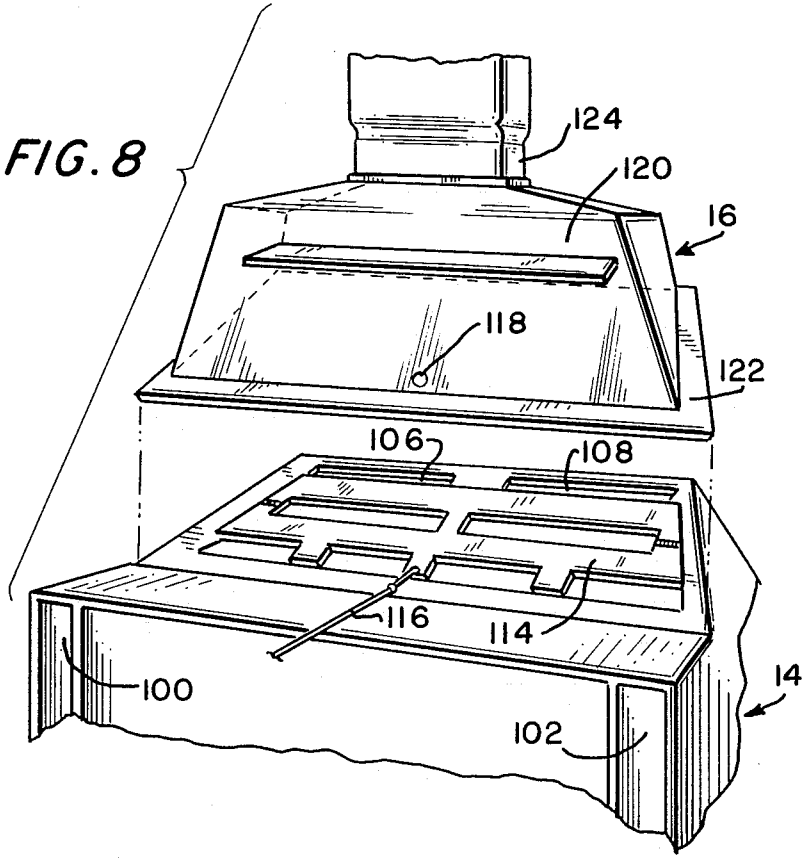
FIG. 8 is a perspective illustration of the sliding dampers interposed between the heating jacket and the smoke chamber.

The heating jacket base 12 is a substantially rectangular box, with side walls 24 and 26 and a rear wall 28, the same being joined to an upper plate 30 and a lower plate 32. The upper plate 30 has a void 34 formed therein in which to receive a grating 36 (FIG. 3). Too, the void 34 is provided to seat therewithin an ashbox 38 (FIG. 10), the ashbox 38 being accommodated below the grating 36. Substantially parallel side panels 40 and 42, and a rear panel 44 frame in the ash box area about a void 45 formed in the lower plate 32; the void 45 is open to free communication with a fireplace hearth upon which the base 12 is emplaced. In one embodiment of the invention, the rear panel 44 is whole, i.e., unapertured (not shown); in the embodiment depicted the rear panel is apertured to provide access to air blowers 46. A blower access panel 48, which sets in front of the blowers 46, is shown exploded, thereabove, in FIG. 2. The base 12 has a front wall 50 which has vents 52 formed therein. A damper slide 54 (FIG. 11), having a manipulatable rod 56, is carried by the front wall 50, selectively to occlude and to open the vents 52. The vents 52 control the admittance of internal air for combustion. The walls 24, 26 and 28 cooperate with the panels 40, 42 and 44 to define conduits 58 and 60 which admit air, for heating, into the base 12; the air thus admitted is conveyed to apertures 62 and 64, formed in the upper plate 30 where the blowers 46 impel the air into the heating jacket 14. To the left (as viewed in FIG. 2) of the base 12 is a control knob 66. Knob 66 actuates a linkage 68 which controls the opening and closure of butterfly-type closures mounted in the blower access panel 48. The closures 70 monitor the apertures 72 which admit outside air into the base via an outside air vent 74 (FIG. 7). To the right of the base 12 is another control knob 76; it controls a linkage 78 which opens and closes a door 80 pivoted in the vent 74 for admitting outside air to the base 12 for heating thereof.

The base 12 is set right into the pre-existing fireplace 82 (FIG. 1), and leveled, as necessary, by means of leveling screws 84 (only two of the four are shown). If employed (as it is an option), the outside vent 74 is set in place in an outside wall, there having to be provided an opening therefor. Flexible ducts 86 and 88 are joined, at ends thereof, to the apertures 72 and to the outside, combustion air openings 90 and 92.

The heating jacket 14 is set upon the base 12. It is a substantially U-shaped structure having side walls 94 and 96, which are substantially parallel, and are joined to a rear wall 98. The side walls 94 and 96 carry ducts 100 and 102 which open into a hollow wing 104 which is mounted onto the rear wall 98. The wing 104 confines therewithin further ducts 106 and 108. The rear wall 98 is hollow and, at the bottom thereof, has a pair of apertures 110 and 112. The latter communicate with the apertures 62 and 64, to admit air for heating thereof into the rear wall and, in turn, the air thus admitted passes into the wing 104 and the ducts 100 and 102. The ducts pass the air (heated by the combustion on the grating 36) into the fireplace site. The combustion gases pass through the ducts 106 and 108, and in front of the wing 104, for evacuation via the smoke chamber 16 and the flue lining 18.

A sliding damper 114, hinged in the center thereof, is provided atop the heating jacket 14, for controlling the draft via the ducts 106 and 108. The damper 114 is slidably moved via a control rod 116 coupled thereto and extending into the front of the unit 10. The smoke chamber 16 has an aperture 118 formed therein to accommodate the rod 116. Too, the smoke chamber has a hood 120, fixed to a frame 122, and the sides of the hood confine the damper 114 to constrain it to straight, reciprocable movement. The smoke chamber 16 has a topmost vent 124 to which the flue lining 18 is attached.

The flue lining 18 is formed of flexible pipe 126 which is encased by metal foil 128 for insulation. In turn, the foil 128 and pipe 126 is enwrapped with metal mesh 130. The lowermost end of the lining 18 is fastened to the vent 124 by means of an adapter 132. The uppermost end is fastened to a metal, top plate 134. A rectangular element of fiberglass insulation is set about the upper end of the flue lining 18, just below the plate 134. A rain cap 136, having a storm collar 138 fixed therabout, is secured to the top of the lining 18 by means of a clamp 140.

Figure 12:
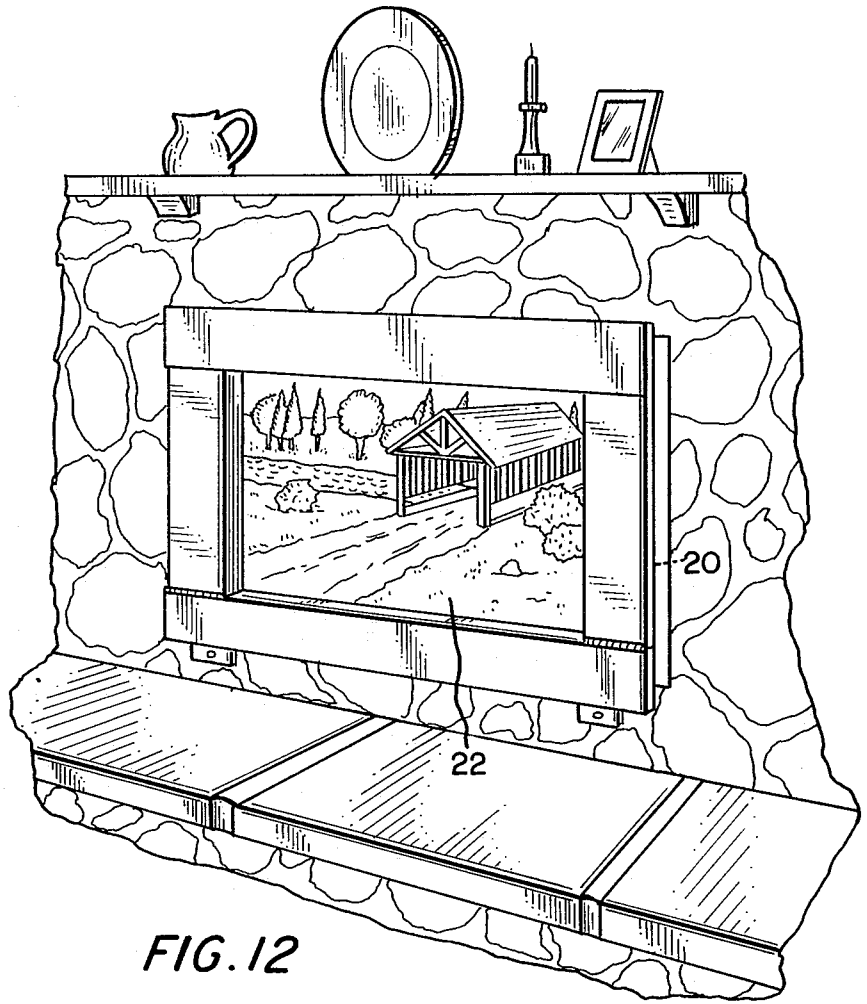
FIG. 12 is a perspective illustration of the decorative, front frame.
Figure 9:
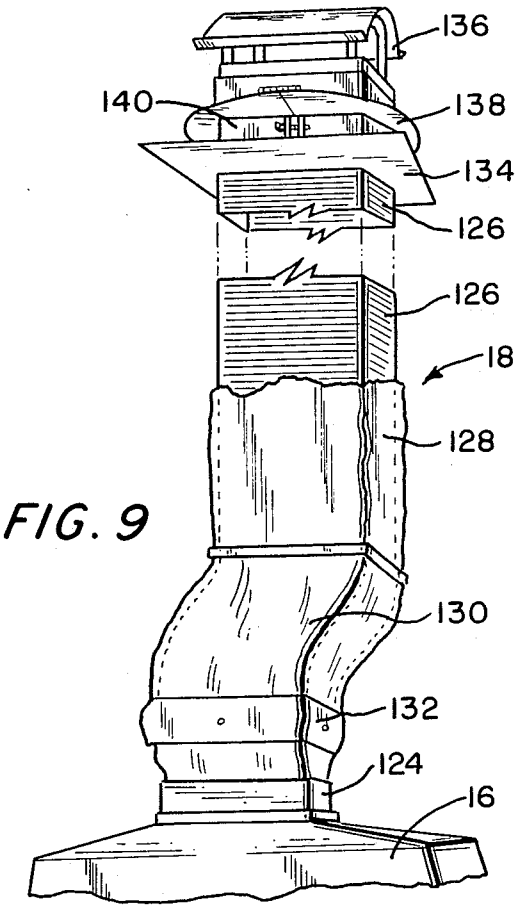
FIG. 9 is a perspective depiction of the flue lining.
Figure 10:
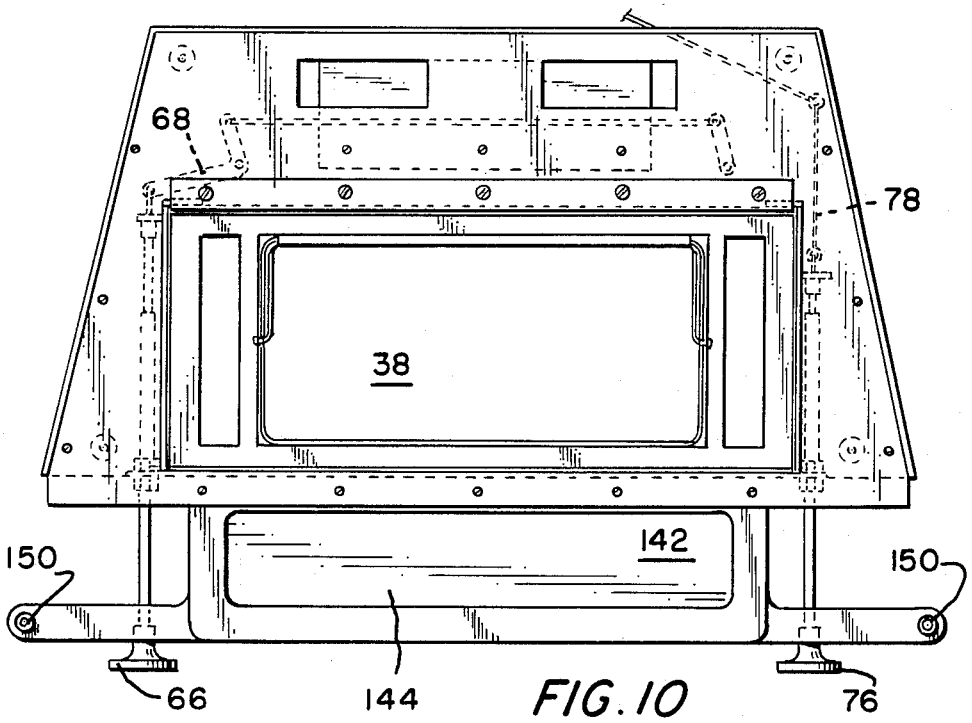
FIGS. 10 and 11 are front and plan views of the heating jacket base again.
Figure 11:
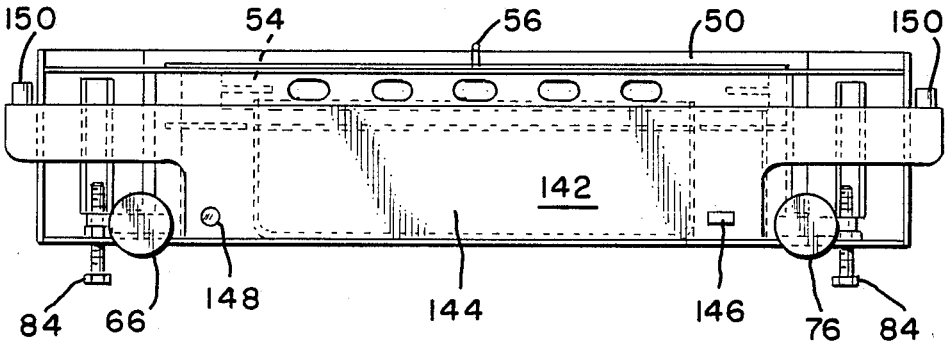

While I have described my invention in connection with a specific embodiment thereof it is to be clearly understood that this is done only by way of example, and not as a limitation to the scope of my invention, as set forth in the objects thereof and in the appended claims. Alternative embodiments and variations will occur to others by taking teaching from my disclosure, and all of such are deemed to be within the scope of my invention and embraced by the claims herein. For example, and as an option, the unit 10 can incorporate means for humidifying the heating air as it exits the unit. FIGS. 10 and 11 depict a humidifier 142 fastened to the front wall 50 of the base 12. Humidifier 142 has a chamber 144 in which water is confined, and a heating element (not shown) is set in the bottom of the chamber. An on/off switch 146 is provided for actuation of the humidifier 142, and a low water indicator lamp 148 is provided as well. At either ends of the humidifier 142 are water vapor outlets 150. The latter are so situated as to introduce water vapor into the streams heating air which passes through the ducts 100 and 102. Too, the front frame 22, used to close off the fireplace when not in use, may be a simple fireproof panel (of metal, or the like). Alternatively, the frame 22 can be a decorative glass/ceramic panel, as shown in FIG. 12.

As to the installation of the unit 10 into an existing fireplace: clearly it is necessary to arrange to have the flue lining 18, smoke chamber 16, etc., sequentially emplaced. The flue lining has to be inserted into the flue, and it requires attachment to the vent 124 of the smoke chamber 16; the latter has to be set up and into the top of the fireplace to accommodate the heating jacket 14 and the base 12 therebelow. The installation procedure, comprising a very detailed order of steps, is not set out here; the same is proprietary to the Crumway Fireplace Improvement System of Denville, N.J., and forms no part of the instant invention which is drawn to the unit 10 per se.

The invention "relines" all internal parts of an existing fireplace: firebox, smoke chamber and flue, without any need to dismantle any of the existing structure. The uppermost portion of the flue lining 18 seals off air between the chimney and the interior of the house; hence, it is safe to leave a live ash bed unattended overnight. Central heat cannot go up the chimney, and cold air and/or chimney odors cannot be downdrafted into the house. Without using the unit for heating it may be employed to expel stale interior air through the chimney. By means of the vent 74 outside air can be introduced for exchanging inside stale air, and for ingesting air more rapidly than the fireplace can draw inside air when the fireplace is in use.

I claim:

1. A fireplace restoration unit, comprising:

a fireplace body, for fully recessed emplacement within an existing masonry fireplace, having an open bottom for setting directly upon, and effecting an open communication with, a fireplace hearth; and a flexible flue lining, (a) for coupling thereof to said body, and (b) for insertion thereof into the flue of such an existing masonry fireplace.

2. A fireplace restoration unit, according to claim 1, wherein:

said body comprises a heating jacket;

said jacket has first ducting for passing heating air therethrough, and second ducting for passing combustion gases therethrough; and one of said first and second ductings is confined within the other of said ductings.

3. A fireplace restoration unit, according to claim 2, wherein:

said second ducting is confined within said first ducting.

4. A fireplace restoration unit, according to claim 2, wherein:

said heating jacket is a substantially U-shaped structure having a rear wall, and substantially parallel side walls joined to said rear wall, and a fully open front to accommodate fueling and observation of combustion therethrough; and said first ducting is formed within said walls.

5. A fireplace restoration unit, according to claim 4, wherein:

said rear wall has a front wing, opposite ends of which are joined to said side walls; and said second ducting is formed within said front wing.

6. A fireplace restoration unit, according to claim 2, wherein:

said first and second ductings define channels for passing heating air and combustion gases therethrough in transverse directions therebetween.

7. A fireplace restoration unit, according to claim 4, wherein:

said rear wall has a top and a bottom; and said bottom has means formed therein for admitting heating air directly, from below said jacket, into said rear wall.

8. A fireplace restoration unit, according to claim 5, wherein:

said front wing comprises an open chamber which is in open communication with said side walls, has a top plate and a bottom plate; and said second ducting comprises ducts fixed in said top and bottom plates, and extending therebetween.

9. A fireplace restoration unit, comprising:

a fireplace body, for emplacement within an existing masonry fireplace; and a flexible flue lining (a) for coupling thereof to said body, and (b) for insertion thereof into the flue of such an existing masonry fireplace; wherein said body comprises a heating jacket;

said jacket has first ducting for passing heating air therethrough, and second ducting for passing combustion gases therethrough;

one of said first and second ductings is confined within the other of said ductings;

said body further comprises a heating jacket base upon which to receive said heating jacket;

said base comprises a substantially rectangular, shallow box;

said box has substantially parallel side walls, and a rear wall, an upper plate and a lower plate, and a front wall; and said upper plate has a void formed therein in which to receive a grating.

10. A fireplace restoration unit, according to claim 9, further including:

substantially parallel side panels, and a rear panel, joining said upper and lower plates, within said box, defining a compartment for an ash box.

11. A fireplace restoration unit, according to claim 10, wherein:

said panels and said side and rear walls of said heating jacket cooperatively define conduits for admitting air thereinto for subsequent heating.

12. A fireplace restoration unit, according to claim 11, wherein:

said rear wall of said heating jacket has a top and a bottom;

said bottom has means formed therein for admitting heating air into said jacket rear wall; and said upper plate has means formed therein for communication with said heating air admitting means of said bottom of said jacket, for communicating said conduits with said rear wall of said jacket.

13. A fireplace restoration unit, according to claim 11, wherein:

said conduits open onto the front of said heating jacket base, at opposite ends of said front wall of said base; and said front wall of said base has vents formed therein for admitting combustion air therethrough into said base.

14. A fireplace restoration unit, according to claim 13, further including:

a damper slide, reciprocably mounted to said front wall of said base, for selectively occluding and opening said vents.

15. A fireplace restoration unit, comprising;

a fireplace body, for emplacement within an existing masonry fireplace; and a flexible flue lining, (a) for coupling thereof to said body, and (b) for insertion thereof into the flue of such an existing masonry fireplace; wherein said body comprises a heating jacket;

said jacket has first ducting for passing heating air therethrough, and second ducting for passing combustion gases therethrough;

one of said first and second ductings is confined within the other of said ductings;

said heating jacket has a rear wall, and substantially parallel side walls joined to said rear wall, and an open front;

said first ducting is formed within said walls;

said rear wall has a front wing, opposite ends of which are joined to said side walls;

said second ducting is formed within said front wing;

said front wing comprises an open chamber which is in open communication with said side walls, has a top plate and a bottom plate;

said second ducting comprises ducts fixed in said top and bottom plates and extending therebetween; and further including means slidably supported on said top plate for closing off and for opening said second ducting, the same comprising a damper for said unit.

16. A fireplace restoration unit, according to claim 9, further including:

a blower access panel, for disposition upon said lower plate, between said side walls of said base, and against said rear wall of said base;

air blowers confined within said base, behind said access panel; and wherein said access panel has openings formed therein for admitting combustion air therethrough into said base.

17. A fireplace restoration unit, according to claim 16, further including:

flexible conduits for attachment to said panel openings, at first ends thereof, and for attachment to an outside air vent at second ends thereof.

18. A fireplace restoration unit, according to claim 17, further including:

an outside air vent, for installation thereof in an outer wall of the site of an existing masonry fireplace, and for receiving thereat said second ends of said flexible conduits.

19. A fireplace restoration unit, according to claim 18, wherein:

said air vent has a hinged door for admitting heating air therethrough, and end channels for communication with, and admitting combustion air to said second ends of said flexible conduits.

20. A fireplace restoration unit, according to claim 19, further including:

control linkage, coupled to said door and front wall of said heating jacket base, operative for opening and closing said door.

21. A fireplace restoration unit, according to claim 16, wherein:

said access panel has pivotable closure elements mounted therein for occluding and for opening said combustion air admitting openings; and further including control linkage, coupled to said elements, and mounted in said front wall of said heating jacket base, operative for pivoting said elements.

22. A fireplace restoration unit, according to claim 9, further including:

means for humidifying heating air which passes through said first ducting coupled to said heating jacket base.

23. A fireplace restoration unit, according to claim 22, wherein:

said humidifying means comprises a humidifier mounted to said front wall of said base.

24. A fireplace restoration unit, according to claim 23, wherein:

said humidifier comprises a water container;

said container having water vapor outlets at opposite ends thereof; and electrical means confined within said container for heating water therewithin.

25. A fireplace restoration unit, according to claim 1, wherein:

said lining comprises rectangular, flexible pipe.

26. A fireplace restoration unit, according to claim 25, wherein:

said lining further comprises metal foil encasing said pipe.

27. A fireplace restoration unit, according to claim 26, wherein:

said lining further includes metal mesh encasing said foil and said pipe.

28. For a fireplace restoration unit, a heating jacket and a base therefor, comprising:

a substantially rectangular, shallow box; wherein said box has substantially parallel side walls, and a rear wall, an upper plate and a lower plate, and a front wall; and a blower access panel, for disposition upon said lower plate, between said side walls of said box, and against said rear wall of said box;

air blowers confined within said box, behind said access panel; wherein said access panel has openings formed therein for admitting air therethrough into said box;

conduits for attachment to said panel openings, at first ends thereof, and for attachment to an outside air vent at second ends thereof;

an outside air vent, for installation thereof in an outer wall of the site of an existing masonry fireplace, and for receiving thereat said second ends of said conduits;

a jacket, for disposition thereof upon said box; wherein said jacket has ducting for passing air therethrough.

29. A heating jacket and base therefor, according to claim 28, wherein:

said jacket is a substantially U-shaped structure having a rear wall, and substantially parallel side walls joined to said rear wall, and a fully open front; and said ducting is formed within said walls.

* * * * *